US010842334B2

(12) United States Patent
Wolff et al.

(10) Patent No.: US 10,842,334 B2
(45) Date of Patent: Nov. 24, 2020

(54) FILTERING DEVICES FOR EVACUATION STATIONS

(71) Applicant: iRobot Corporation, Bedford, MA (US)

(72) Inventors: Andrew Vincent Wolff, Norfolk, MA (US); Ellen B. Cargill, Norfolk, MA (US); Douglas Dell'Accio, Boston, MA (US); Jason Jeffrey Suchman, Arlington, MA (US); Flavia Pastore, Wakefield, MA (US)

(73) Assignee: iRobot Corporation, Bedford, MA (US)

( * ) Notice: Subject to any disclaimer, the term of this patent is extended or adjusted under 35 U.S.C. 154(b) by 215 days.

(21) Appl. No.: 15/971,322

(22) Filed: May 4, 2018

(65) Prior Publication Data

US 2019/0335967 A1 Nov. 7, 2019

(51) Int. Cl.

*A47L 9/14* (2006.01)
*A47L 9/28* (2006.01)
*A47L 9/00* (2006.01)

(52) U.S. Cl.

CPC ..... *A47L 9/2821* (2013.01); *A47L 9/0063* (2013.01); *A47L 9/1418* (2013.01); *A47L 9/2815* (2013.01); *A47L 2201/024* (2013.01)

(58) Field of Classification Search

CPC ..... A47L 5/28; A47L 9/1683; A47L 9/127; A47L 9/1666; A47L 9/1691; A47L 9/2821; A47L 9/0063; A47L 9/1418; A47L 9/2815; A47L 2201/024; A47L 9/10; A47L 9/102; A47L 9/106; A47L 9/12; A47L 9/125; A47L 9/14; A47L 9/1427; A47L 9/1436;

(Continued)

(56) References Cited

U.S. PATENT DOCUMENTS 3,242,654 A * 3/1966 Kornstien ..... A47L 9/1436 55/376
3,483,679 A * 12/1969 Balbierer ..... A47L 9/1436 55/367

(Continued)

FOREIGN PATENT DOCUMENTS

DE 102010017213 12/2011
EP 0339323 11/1989

OTHER PUBLICATIONS

European Search Report in European Application No. 19172501, dated Sep. 9, 2019, 4 pages.

(Continued)

*Primary Examiner* — Robert J Scruggs
(74) *Attorney, Agent, or Firm* — Fish & Richardson P.C.

(57) ABSTRACT

A bag-based filtering device for collecting debris from a cleaning robot via a debris evacuation station includes a filter bag configured to separate at least the portion of the evacuated debris from a flow of air generated by the evacuation station. The filtering device includes a conduit extending inward from an opening of the filter bag into the receptacle. The conduit is configured to pneumatically connect a receptacle of the filtering device with an inlet of the filtering device to direct the flow of air generated by the evacuation station through the filter bag to separate at least the portion of the evacuated debris from the flow of air.

29 Claims, 11 Drawing Sheets

(58) Field of Classification Search
CPC ..... A47L 9/1463; A47L 9/1472; A47L 9/149; A47L 9/16
See application file for complete search history.

(56) References Cited

U.S. PATENT DOCUMENTS

| | | | | |
|---|---|---|---|---|
| 5,092,915 | A * | 3/1992 | Lackner | A47L 9/1427 15/351 |
| 5,634,238 | A * | 6/1997 | McCaffrey | A47L 7/0009 15/322 |
| 5,863,425 | A * | 1/1999 | Herlehy | A47L 9/1427 15/1.7 |
| 6,076,226 | A | 6/2000 | Reed | |
| 6,389,329 | B1 | 5/2002 | Colens | |
| 6,618,898 | B2 * | 9/2003 | Tingle | A01K 1/01 15/327.7 |
| 6,748,297 | B2 | 6/2004 | Song et al. | |
| 7,031,805 | B2 | 4/2006 | Lee et al. | |
| 7,055,210 | B2 | 6/2006 | Keppler et al. | |
| D524,497 | S | 7/2006 | Bruneau | |
| 8,092,562 | B2 | 1/2012 | Sauer et al. | |
| 8,528,157 | B2 | 9/2013 | Schnittman et al. | |
| 9,027,199 | B2 | 5/2015 | Jung et al. | |
| 9,462,920 | B1 | 10/2016 | Morin et al. | |
| 2003/0070253 | A1 * | 4/2003 | Rolland | A01J 7/022 15/404 |
| 2004/0163205 | A1 * | 8/2004 | Albert | A47L 9/1427 15/352 |
| 2005/0150519 | A1 | 7/2005 | Keppler et al. | |
| 2007/0226949 | A1 | 10/2007 | Hahm et al. | |
| 2008/0201895 | A1 | 8/2008 | Kim et al. | |
| 2008/0235897 | A1 | 10/2008 | Kim et al. | |
| 2009/0049640 | A1 | 2/2009 | Lee et al. | |
| 2011/0219574 | A1 * | 9/2011 | Conrad | A47L 9/1683 15/347 |
| 2012/0011677 | A1 | 1/2012 | Jung et al. | |
| 2013/0031744 | A1 * | 2/2013 | Ota | A47L 9/106 15/348 |
| 2013/0298350 | A1 | 11/2013 | Schnittman et al. | |
| 2016/0166126 | A1 * | 6/2016 | Morin | A47L 7/0004 15/319 |
| 2016/0183752 | A1 * | 6/2016 | Morin | A47L 9/14 134/18 |

OTHER PUBLICATIONS

[No Author Listed] "Bosch Part#462544—Genuine Type G MEGA filt SuperTex Vacuum Bag (BBZ51AFG2U)—Fits Bosch Compact Series and Formula Series Vacuums—5/Package," Dec. 29, 2011, retrieved on May 10, 2018, retrieved from URL <https://www.amazon.com/Bosch-Part-462544-MEGAfilt-BBZ51AFG2U/dp/B000UM2ENE/>, 8 pages.

[No Author Listed] "Staubaugerbeutel Von Kobold," retrieved on May 10, 2018, retrieved from URL <https://kobold.vorwerk.de/staubsaugerbeutel/>, 49 pages. (English Translation).

* cited by examiner

FILTERING DEVICES FOR EVACUATION STATIONS

TECHNICAL FIELD

This specification relates to filtering devices for evacuation stations.

BACKGROUND

Autonomous cleaning robots are robots that can perform desired cleaning operations, such as vacuum cleaning, in environments without continuous human guidance. An autonomous cleaning robot can automatically dock with an evacuation station for the purpose of emptying its debris bin of vacuumed debris. During an evacuation operation, the evacuation station can draw debris collected by the robot into the evacuation station. The drawn debris can be stored in a receptacle within the evacuation station. When the debris collected in the receptacle has reached a debris capacity of the receptacle, a user can manually remove the debris so that the evacuation station can perform additional evacuation operations.

SUMMARY

The systems, devices, methods, and other features described herein can include the advantages below and described herein elsewhere. For example, the features described herein can improve the efficiency and performance of autonomous cleaning robots, evacuation stations, and filtering devices.

The conduit of the filtering device described herein can inhibit debris from accumulating at or near an interface between the conduit of the filtering device and a conduit of an evacuation station. Debris drawn from a cleaning robot could clog a flow path for debris within the evacuation station even though the filtering device has remaining capacity to receive additional debris. The size, shape, dimensions, and other geometric attributes of the conduit of the filtering device can reduce the likelihood that the debris accumulates within the conduit of the evacuation station or near the interface between the filtering device and the conduit of the evacuation station. A clog or obstruction can thus be less likely to form proximate the conduit of filtering device.

A user can more easily remove a filtering device that has been filled with debris without a risk that a large portion of the debris is dislodged from the filtering device into an environment. With less debris accumulating at the conduit of the evacuation station, debris can be less likely to accumulate near an opening of the filtering device. As a result, when the user removes a full filtering device from the evacuation station, debris can be contained within the filtering device. The user need not engage in additional cleanup effort, e.g., to clean up debris that has escaped the filtering device into the environment, after removing the filtering device from the evacuation station.

The evacuation station can more easily detect a clog or other obstruction that can impede airflow along airflow pathways in the evacuation station. The evacuation station can also autonomously remove a detected clog or obstruction by operating an air mover of the evacuation station to remove the clog. The evacuation station can also detect when the filtering device should be replaced in response to air pressure changes proximate the filtering device. Because the filtering device conduit can inhibit the formation of clogs and obstructions proximate the conduit, the detected air pressure change can be less likely to simply be an indication of an obstruction in the filtering device or the conduit and can more likely be an indication that the filtering device has reached its capacity for debris. The evacuation station can be hence less likely to throw a false positive detection of a full filtering device.

The filtering device can increase the number of evacuations that the evacuation station can perform before the filtering device needs to be replaced. As a result, an autonomous cleaning robot from which debris is evacuated can perform more cleaning operations and can collect more debris for evacuation by the evacuation station before the filtering device should be replaced.

In one aspect, a bag-based filtering device for collecting debris from a cleaning robot via a debris evacuation station is featured. The filtering device includes a filter bag at least partially forming a receptacle for receiving at least a portion of the evacuated debris. The filter bag is configured to separate at least the portion of the evacuated debris from a flow of air generated by the evacuation station. The filtering device includes an inlet configured to interface with an outlet of the evacuation station, and a conduit extending inward from an opening of the filter bag into the receptacle. The conduit includes an opening proximate the inlet, and the opening of the conduit has a width greater than a width of an opening of the inlet. The conduit is configured to pneumatically connect the receptacle with the inlet of the filtering device to direct the flow of air generated by the evacuation station through the filter bag to separate at least the portion of the evacuated debris from the flow of air.

In another aspect, an evacuation station for reducing obstructions in a filtering device inlet is featured. The evacuation station includes one or more conduits including an intake configured to interface with a cleaning robot. The evacuation station includes a filtering device including a filter bag at least partially forming a receptacle, an inlet configured to interface with an outlet of the one or more conduits, and a conduit configured to pneumatically connect the inlet to the receptacle. The conduit extends inward from an opening of the filter bag into the receptacle. The evacuation station includes an air mover configured to produce a flow of air containing debris from a debris bin of the cleaning robot. The flow of air travels through the one or more conduits, through the conduit of the filtering device, and through the filter bag such that at least a portion of the debris is separated from the flow of air and received by the receptacle.

In another aspect, a method of operating an evacuation station includes initiating a first evacuation process in which an air mover is activated for a predefined duration of time, determining that a receptacle of a filtering device is nearing a full state based on a pressure detected by a pressure sensor, and in response to determining that the receptacle of the filtering device is nearing the full state, initiating a second evacuation process in which the air mover is activated for the predefined duration of time.

Implementations can include the examples described below and herein elsewhere.

In some implementations, the conduit of the filtering device can include a first opening. In some implementations, the opening of the conduit of the filtering device can be a first opening of the conduit of the filtering device. The conduit of the filtering device can taper inward from the opening of the filter bag along at least a portion of the conduit of the filtering device. A free end portion of the conduit of the filtering device can include a second opening having a width 1 to 2 times larger than an overall distance from the opening of the filter bag to the second opening of the conduit.

In some implementations, the filtering device can further include a cover slidable relative to the opening of the filter bag between an open position in which the opening of the filter bag is accessible and a closed position in which the opening of the filter bag is inaccessible. The filtering device can further include a collar attached to the filter bag. The cover can be slidable relative to the collar between the open position and the closed position.

In some implementations, the cover can include a body and an opening. The body can be configured to cover the opening of the filter bag when the cover is in the closed position, and the opening of the cover can be configured to align with the opening of the filter bag when the cover is in the open position.

In some implementations, the inlet of the filtering device can include an outward facing seal configured to interface with the outlet of the evacuation station. The outward facing seal can define the opening of the inlet. The outlet of the evacuation station can be an outlet of one or more conduits of the evacuation station.

In some implementations, a width of the second opening of the conduit of the filtering device can be substantially equal to a width of the opening of the inlet of the filtering device. The width of the second opening of the conduit and the width of the opening of the inlet can be between 2 cm and 5 cm.

In some implementations, the conduit of the filtering device can include a substantially frustoconical portion.

In some implementations, the filtering device further can include a collar positioned along the opening of the filter bag. The collar can be attached to the filter bag and attached to the conduit of the filtering device.

In some implementations, the conduit of the filtering device can include a first portion of a snap fit mechanism attached to a second portion of the snap fit mechanism on the collar.

In some implementations, the conduit of the filtering device can be formed of a rigid polymer.

In some implementations, a length of the conduit of the filtering device can be between 1 and 4 cm.

In some implementations, an angle between an outer surface of the conduit of the filtering device and a longitudinal axis of the conduit of the filtering device can be between 10 and 45 degrees.

In some implementations, the conduit of the filtering device can include a first opening. In some implementations, the opening of the conduit of the filtering device can be a first opening of the conduit of the filtering device. A width of a second opening of the conduit of the filtering device at a free end portion of the conduit of the filtering device can be between 2 cm and 5 cm.

In some implementations, the conduit can be configured to inhibit accumulation of debris within the conduit.

In some implementations, the evacuation station further includes a sensor positioned proximate a flow path for the flow of air, and a controller configured to prevent an evacuation process from being initiated in response to the sensor detecting that the receptacle of the filtering device is in a full state. In some implementations, the method further includes preventing an evacuation process from being initiated in response to detecting that the receptacle of the filtering device is in a full state.

In some implementations, the evacuation station further includes a sensor positioned proximate a flow path for the flow of air, and a controller configured to provide an alert indicating that the filtering device should be replaced in response to detecting that the receptacle of the filtering device is nearing or at a full state.

In some implementations, the evacuation station further includes a pressure sensor positioned proximate a flow path for the flow of air, and a controller. The controller can be configured to initiate a first evacuation process in which the air mover is activated for a predefined duration of time, determine that the receptacle of the filtering device is nearing a full state based on a pressure detected by the pressure sensor, and in response to determining that the receptacle of the filtering device is nearing the full state, initiate a second evacuation process in which the air mover is activated for the predefined duration of time.

The details of one or more implementations of the subject matter described in this specification are set forth in the accompanying drawings and the description below. Other potential features, aspects, and advantages will become apparent from the description, the drawings, and the claims.

DETAILED DESCRIPTION

An evacuation station for an autonomous cleaning robot can be used to evacuate debris collected by the robot between cleaning operations performed by the robot. After the robot performs a cleaning operation and collects debris, the evacuation station can generate an airflow to draw debris contained in the robot into a receptacle of the evacuation station, thereby enabling the robot leave the evacuation station and perform another cleaning operation to collect more debris. A conduit in the receptacle to direct debris received from the robot into the receptacle can be susceptible to clogs or other obstructions that can prevent a full debris capacity of the receptacle from being utilized. As described herein, a filtering device containing the receptacle can include a conduit that is configured to inhibit formation of clogs or other obstructions proximate the conduit.

Figure 1:
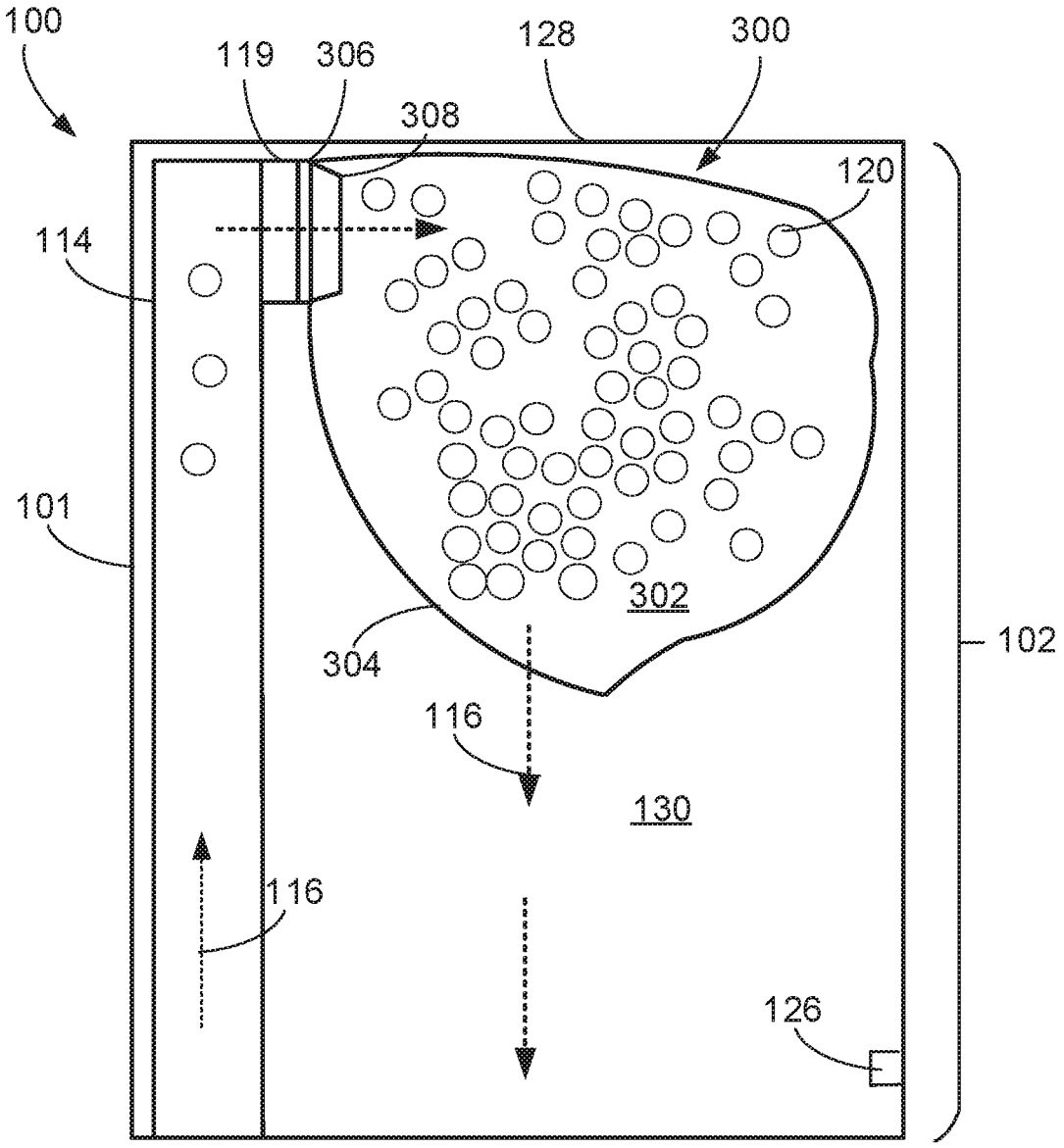
FIG. 1 is a schematic side view of a portion of an evacuation station with a filtering device.

Referring to FIG. 1, an evacuation station 100 includes a top portion 102 within which a filtering device 300 with a receptacle 302 for debris is located. The filtering device 300 includes a filter bag 304 at least partially forming the receptacle 302. The filtering device 300 further includes an inlet 306 and a conduit 308. The inlet 306 is configured to interface with an outlet of one or more conduits of the evacuation station 100. For example, the one or more conduits of the evacuation station 100 includes a conduit 114 that includes an outlet 119 configured to interface with the inlet 306. The conduit 308 of the filtering device 300 is configured to pneumatically connect the inlet 306 of the filtering device 300 to the receptacle 302. The conduit 308 extends inwardly, from the inlet 306 into the receptacle 302. The conduit 308 is an example of a conduit described herein configured to inhibit accumulation of debris within the conduit and thereby inhibit the formation of clogs or obstructions proximate the conduit 308.

The evacuation station 100 includes a housing 101 (shown in FIGS. 1-4). The housing 101 of the evacuation station 100 can include one or more interconnected structures that support various components of the evacuation station 100, including an air mover 117 (shown in FIG. 2), a system of airflow paths for airflow generated by the air mover 117, and a controller 113 (shown in FIG. 2).

Figure 2:
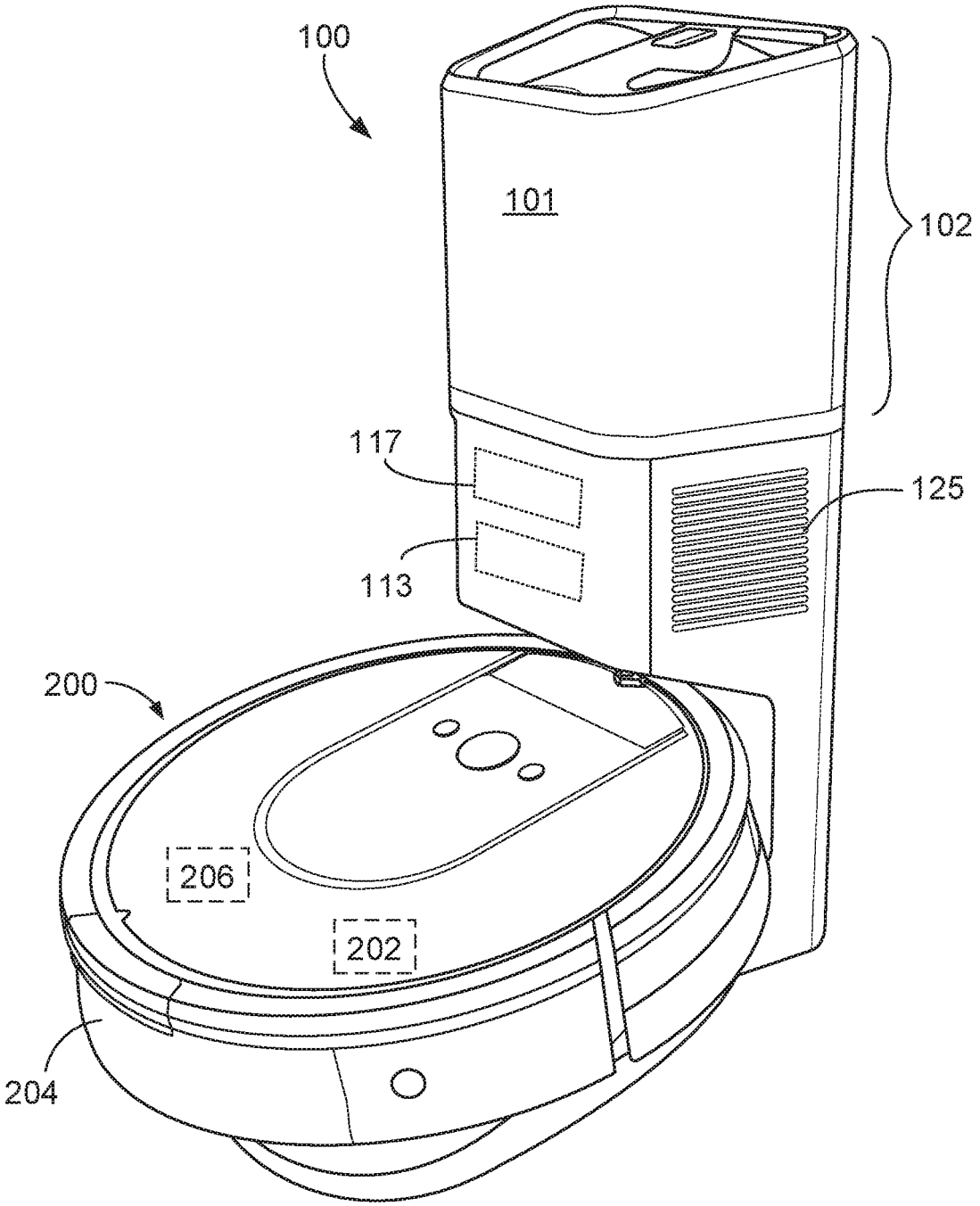
FIG. 2 is a front perspective view of a system including an autonomous mobile robot and the evacuation station of FIG. 1.

FIG. 1 illustrates the evacuation station 100 during an evacuation operation in which the controller 113 operates the air mover 117 to generate airflow 116 through air pathways of the evacuation station 100. Referring to FIG. 2 showing a system, e.g., a debris collection system, including the evacuation station 100 and an autonomous cleaning robot 200, the evacuation station 100 performs an evacuation operation when the autonomous cleaning robot 200 and the evacuation station 100 are interfaced with one another. The robot 200 performs a cleaning operation in a room, e.g., a room of a commercial, residential, industrial, or other type of building, and collects debris from a floor surface of the room as the robot 200 autonomously moves about the room. The robot 200 includes implements that enable the robot to collect the debris from the floor surface. For example, the robot 200 can include an air mover 202 that draws air from a portion of the floor surface below the robot 200 and hence draws any debris on that portion of the floor surface into the robot 200. The robot 200 can also include one or more rotatable members (not shown) facing the floor surface that engage the debris on the floor surface and mechanically moves the debris into the robot 200. The one or more rotatable members can include a roller, a brush, a flapper brush, or other rotatable implements that can engage debris and direct the debris into the robot 200. The debris collected from the floor surface is directed into a debris bin 204 of the robot 200. A controller 206 of the robot 200 operates a drive system (not shown) of the robot 200, e.g., including motors and wheels that are operable to propel the robot 200 across the floor surface, to navigate the robot 200 about the room and thereby clean different portions of the room.

During the cleaning operation, the controller 206 can determine that the debris bin 204 is full. For example, the controller 206 can determine that debris accumulated in the debris bin 204 has exceeded a certain percentage of the total debris capacity of the debris bin 204, e.g., more than 70%, 80%, or 90% of the total debris capacity of the debris bin 204. After making such a determination, the controller 206 operates the drive system of the robot 200 to direct the robot 200 toward the evacuation station 100. In some implementations, the robot 200 includes a sensor system including an optical sensor, an acoustic sensor, or other appropriate sensor for detecting the evacuation station 100 during the robot's navigation about the room to find the evacuation station 100.

The evacuation station 100 can perform an evacuation operation to draw debris from the debris bin 204 of the robot 200 into the evacuation station 100. To enable the evacuation station 100 to remove debris from the robot 200, the robot 200 interfaces with the evacuation station 100. For example, the robot 200 can autonomously move relative to the evacuation station 100 to physically dock to the evacuation station 100. In other implementations, a conduit (not shown) of the evacuation station 100 is manually connected to the robot 200. To interface with the evacuation station 100, in some implementations, an underside of the robot 200 includes an outlet (not shown) that engages with the intake 118 of the evacuation station 100, shown in FIG. 3. For example, the outlet of the robot 200 can be located on an underside of the debris bin 204 and can be an opening that engages with a corresponding opening of the intake 118.

One or both of the robot 200 and the evacuation station 100 can include a valve mechanism that opens only when the air mover 117 generates a negative pressure during the evacuation operation. For example, a valve mechanism (not shown) of the robot 200 can include a door, flap, or other openable device that only opens in response to a negative pressure on the underside of the debris bin 204, e.g., a negative pressure generated by the air mover 117 of the evacuation station 100.

While the robot 200 interfaces with the evacuation station 100, the debris bin 204 is in pneumatic communication with the air mover 117 of the evacuation station 100. In addition, in some implementations, the robot 200 is in electrical communication with the evacuation station 100 such that the evacuation station 100 can charge a battery of the robot 200 when the robot 200 interfaces with the evacuation station 100. Thus, while interfaced with the robot 200, the evacuation station 100 can simultaneously evacuate debris from the robot 200 and charge the battery of the robot 200. In other implementations, the evacuation station 100 charges the battery of the robot 200 only while the evacuation station 100 is not evacuating debris from the robot 200.

Referring also to FIG. 1, during the evacuation operation while the evacuation station 100 is interfaced with the robot 200, the airflow 116 generated by the evacuation station 100 travels through the debris bin 204, through airflow pathways of the evacuation station 100, and through the filtering device 300 while carrying debris 120 drawn from the robot 200. The airflow pathways of the evacuation station 100 include the one or more conduits of the evacuation station 100. In addition to including the conduit 114, the one or more conduits can also include conduits 122, 124. The conduit 122 includes the intake 118 of the evacuation station 100 and is connected with the conduit 124, and the conduit 124 is connected with the conduit 114. In this regard, the airflow 116 travels through the one or more conduits of the evacuation station 100 by travelling through the conduit 122, the conduit 124, and conduit 114. The airflow 116 exits the one or more conduits through the outlet 119 into the inlet 306 of the filtering device 300, and then travels through the conduit 308. The airflow 116 further travels through a wall of the filter bag 304 toward the air mover 117. The wall of the filter bag 304 serves as a filtering mechanism, separating a portion of the debris 120 from the airflow 116.

In some implementations, the evacuation station 100 can include a removable filter (not shown). The filter can be a small or fine particle filter. For example, particles having a width between about 0.1 to 0.5 micrometers carried by the airflow 116 after the airflow 116 exits the filtering device 300 are removed by the filter. The filter can be positioned between the filtering device 300 and the air mover 117. After the airflow 116 exits the filtering device 300 and travels beyond the filter, the air mover 117 directs the airflow 116 out of the evacuation station 100, in particular, through an exhaust 125 (shown in FIG. 2). As described herein, the evacuation station 100 can continue to perform the evacuation operation until a sensor 126 (shown in FIGS. 1 and 3) of the evacuation station 100 detects that the receptacle 302 is full. In some implementations, the sensor 126 is positioned proximate a flow path for the flow of air. As described herein, in some implementations, the sensor 126 is a pressure sensor. In other implementations, the sensor 126 is an optical sensor, a force sensor, or other sensor that can generate one or more signal indicative of a fullness state of the filtering device 300.

Figure 4:
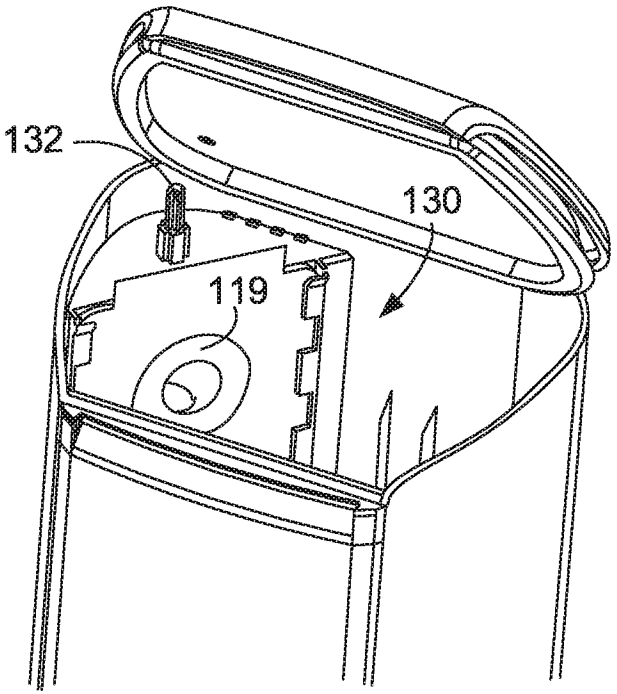
FIG. 4 is a top view of an upper portion of the evacuation station of FIG. 1.
Figure 3:
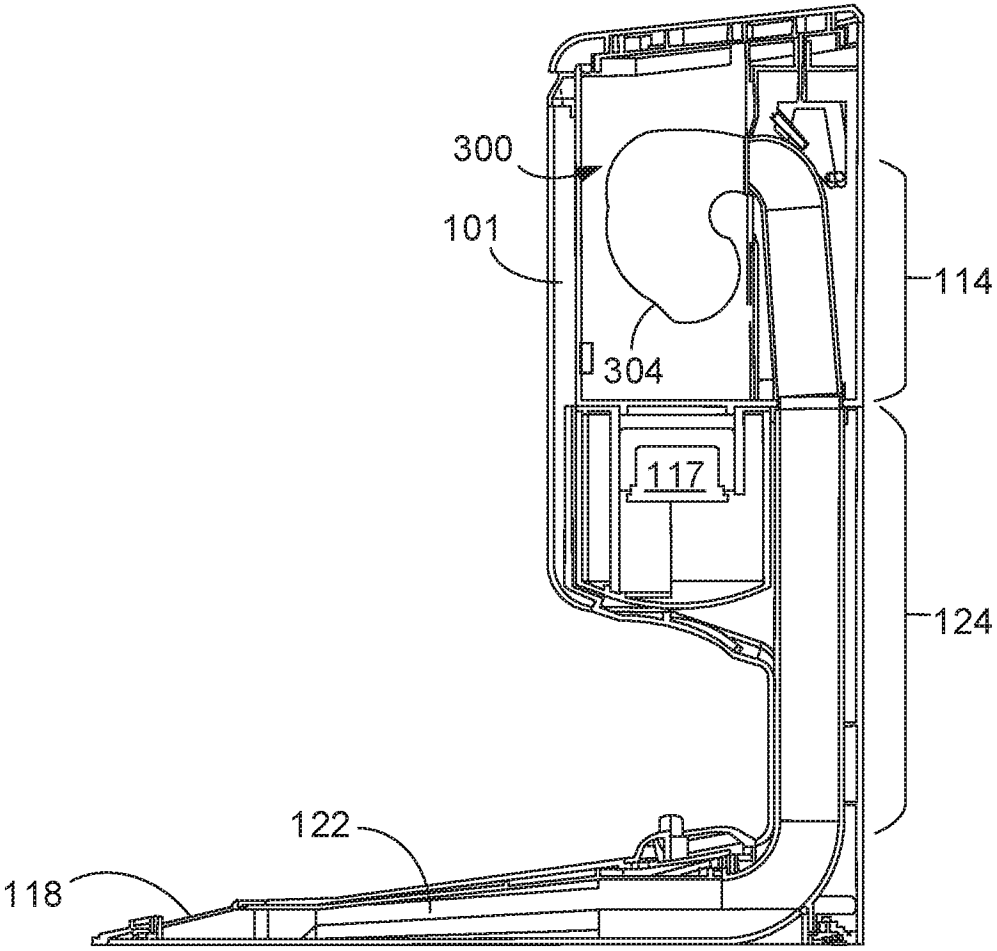
FIG. 3 is a side cross-sectional view of the evacuation station of FIG. 1.

The filtering device 300 is disconnectable and removable from the evacuation station 100. Referring to FIG. 4, the housing 101 of the evacuation station 100 includes a cover 128 along the top portion 102 of the evacuation station 100. The cover 128 covers a receptacle 130 of the evacuation station 100. The receptacle 130 can receive the filtering device 300. The cover 128 is movable between a closed position (shown in FIG. 3) and an open position (shown in FIG. 4). In the open position of the cover 128, a filtering device is insertable into the receptacle 130 or is removable from the receptacle 130. For example, the filtering device 300 can be placed into the receptacle to be connected with the one or more conduits of the evacuation station 100. In addition, the filtering device 300 can be disconnected from the one or more conduits of the evacuation station and then removed from the receptacle 130, thereby enabling a new filtering device to be inserted into the receptacle.

In some implementations, the conduit 114 of the evacuation station 100 is movable in response to movement of the cover 128. For example, when the cover 128 is moved from the closed position to the open position, the conduit 114 moves such that the outlet 119 of the conduit 114 moves into the receptacle 130. The conduit 114 moves from a receded position (shown in FIG. 4) to a protruded position (not shown). In the receded position, the outlet 119 of the conduit 114 is recessed in the housing 101. In the protruded position, the conduit 114 protrudes from the housing 101 into the receptacle 130 such that the outlet 119 moves into to the receptacle 130. In some implementations, the conduit 114 is connected to the conduit 124 in a manner that allows the conduit 114 to pivot or flex relative to the conduit 124, thereby enabling the conduit 114 to move relative to the housing 101.

The evacuation station 100 includes a mechanism for triggering such movement of the conduit 114 in response to movement of the cover 128 from the open position to the closed position. For example, the mechanism includes a movable post 132 that is translated in response to movement of the cover 128 from the open positioned to the closed position. A cam (not shown) on the conduit 114 is configured to interface with the movable post 132 such that, when the movable post 132 moves in response to the movement of the cover 128, the outlet 119 of the conduit 114 moves further into the receptacle 130. As described herein, this inward movement of the outlet 119 causes the outlet 119 to engage with the inlet 306 of the filtering device 300.

Figure 5:
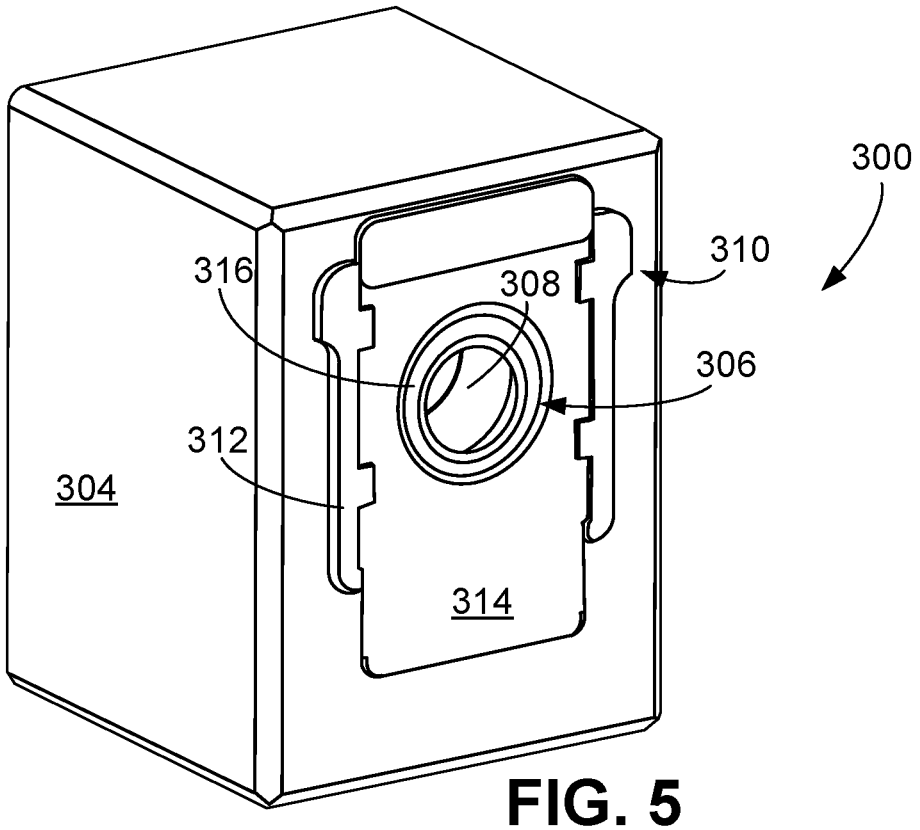
FIG. 5 is a front perspective view of the filtering device of FIG. 1.
Figure 6:
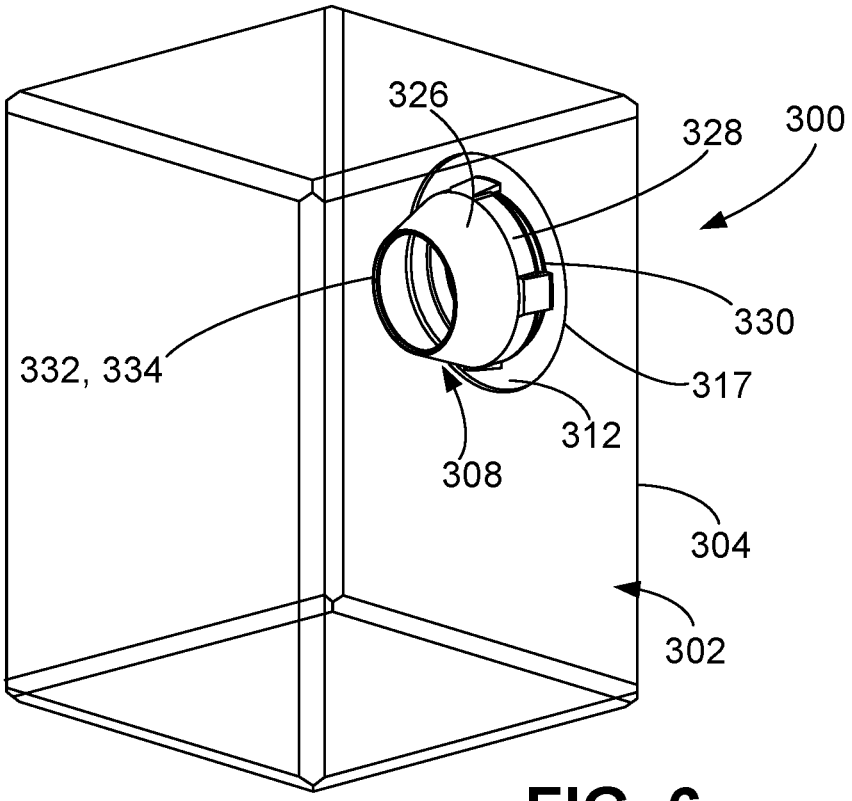
FIG. 6 is a side perspective view of the filtering device of FIG. 1 in which a filter bag of the filtering device is shown as transparent.
Figure 7:
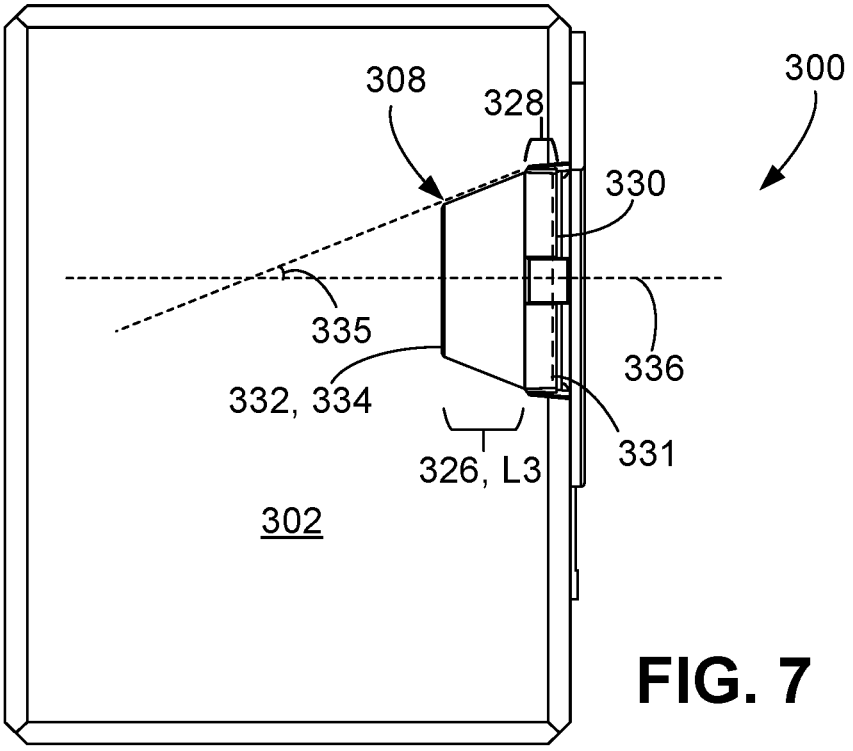
FIG. 7 is a side view of the filtering device of FIG. 1 in which a filter bag of the filtering device is shown as transparent.

FIGS. 5-7 illustrate an example of the filtering device 300. Referring to FIG. 5, the filtering device 300, as described herein, includes the filter bag 304, the inlet 306, and an interface assembly 310. The filtering device 300 can be disposable, e.g., after the debris collected in the receptacle 304 has exceeded a certain debris capacity of the receptacle 302.

The filter bag 304 at least partially forms the receptacle 302 and is formed of a material through which air can travel. The material of the filter bag 304 is selected such that the filter bag 304 can serve as a separator that separates and filters at least a portion of the debris out of the airflow 116 generated by the evacuation station 100. For example, the filter bag 304 can be formed of paper or fabric that allows air to pass through but traps dirt and debris and thereby retains the debris within the receptacle 302. The material of the filter bag 304 is flexible, enabling the filter bag 304 to be folded and easily stored. In addition, the filter bag 304 can expand to accommodate additional debris as the filter bag 304 collects debris during an evacuation operation. The filter bag 304, while collecting debris via filtration, is porous to permit the airflow 116 to exit the filter bag 304 with an amount of debris less than the amount of debris with the airflow 116 as the airflow 116 enters the filtering device 300. For example, the filter bag 304 can collect debris having a width greater than 1 micrometer, e.g., greater than 3 micrometers, 10 micrometers, 50 micrometers, or more.

Figure 8:
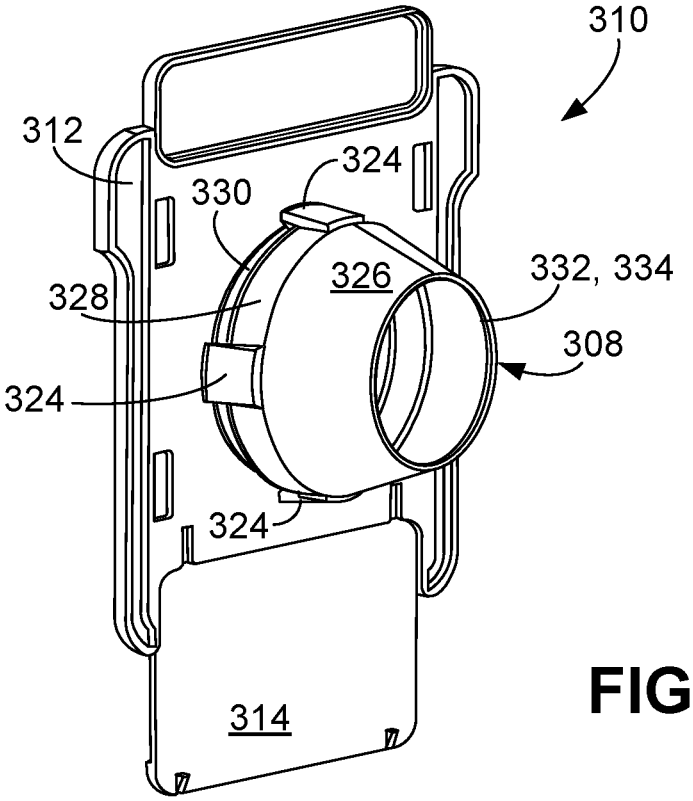
FIG. 8 is a rear perspective view of an interface assembly of the filtering device of FIG.

Referring also to FIG. 8, the interface assembly 310 includes a collar 312, a cover 314, a seal 316, and the conduit 308. The interface assembly 310 is configured to interface with the one or more conduits of the evacuation station 100, e.g., with the conduit 114 (shown in FIGS. 1 and 3). For example, when the filtering device 300 is disposed into the receptacle 130 of the evacuation station 100 and the conduit 114 of the evacuation station 100 is in the protruded position, the intake 118 is placed into pneumatic communication with the receptacle 302 of the filtering device 300. Hence, when the robot 200 interfaces with the evacuation station 100, the debris bin 204 of the robot 200 is also placed into pneumatic communication with the receptacle 302 of the filtering device 300.

The seal 316 is attached to the collar 312 and is configured to engage the conduit 114. In particular, the seal 316 is an outward facing seal, e.g., facing away from the receptacle 302, that is configured to interface with the outlet 119 of the conduit 114. For example, in implementations in which the conduit 114 is movable in response to the movement of the cover 128, the conduit 114 can move into the protruded position and thereby contact the seal 316. The seal 316 is formed of a rubber, another elastomeric material, or a combination of different materials including an elastomeric material. The seal 316 includes an opening 338 that is part of the inlet 306 of the filtering device 300. The seal 316 can form a sealed engagement around an outer surface of the conduit 114. The seal engagement can prevent, inhibit, or otherwise reduce airflow leakage from the conduit 114 when the air mover 117 generates the airflow 116 and thus can improve the efficiency of the air mover 117.

Figure 10:
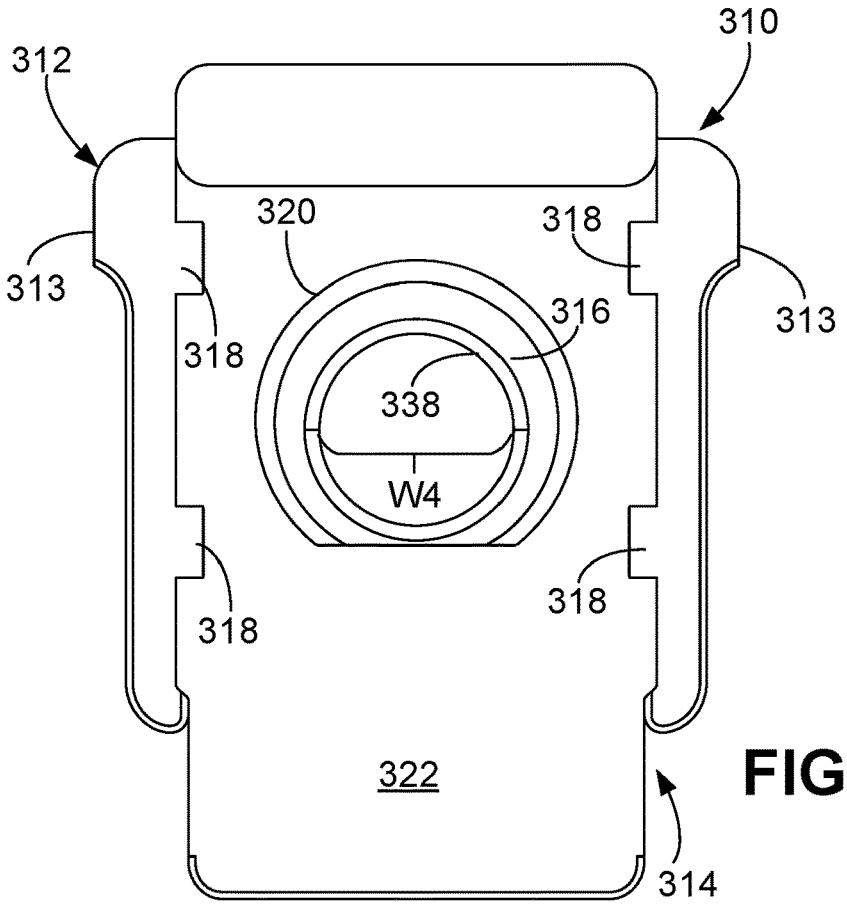
FIG. 10 is a front view of the interface assembly of FIG. 8.

The collar 312 is positioned along an opening 317 of the filter bag 304. The collar 312 is a substantially flat plate. For example, a thickness of the collar 312 is between 1.0 mm and 3.5 mm, e.g., between 1.0 mm and 2.0 mm, 1.5 mm and 2.5 mm, 2.0 mm and 3.0 mm, or 2.5 mm and 3.5 mm. While depicted in FIG. 10 as being substantially rectangular or square, in other implementations, the collar 312 is circular or has a polygonal shape. Referring also to FIG. 10, the collar 312 has a width W1 that is larger than a width W2 of the cover 314. For example the width of the collar 312 is 1.05 to 1.5 times larger than the width of the cover 314. For example, the width W1 of the collar 312 is between 7.0 cm and 12.0 cm, e.g., between 7.0 cm and 8.0 cm, 8.0 cm and 9.0 cm, 9.0 cm and 10.0 cm, 10.0 cm and 11.0 cm, or 11.0 cm and 12.0 cm, and the length W2 of the cover 314 is between 6.0 cm and 9.0 cm, e.g., between 6.0 cm and 6.5 cm, 6.5 cm and 7.0 cm, 7.0 cm and 7.5 cm, 7.5 cm and 8.0 cm, 8.0 cm and 8.5 cm. or 8.5 cm and 9.0 cm.

The collar 312 of the interface assembly 310 is attached directly to the filter bag 304. In some implementations, the collar 312 is welded to the filter bag 304. In other implementations, the collar 312 is attached to the filter bag 304 via a fastener, e.g., via stitches, clips, zippers, and other appropriate fasteners. The collar 312 is formed of a rigid polymeric material, such as polypropylene, polycarbonate, acrylonitrile butadiene styrene, nylon, or another appropriate polymer.

The cover 314 of the interface assembly 310 is movably attached to the collar 312. The cover 314 is a substantially flat plate. For example, a thickness of the cover 314 is between 0.5 mm and 3.5 mm, e.g., between 0.5 mm and 1.5 mm, 1.0 mm and 2.0 mm, 1.5 mm and 2.5 mm, 2.0 mm and 3.0 mm, or 2.5 mm and 3.5 mm. While depicted in FIG. 10 as being substantially rectangular, in other implementations, the cover 314 is circular or has a polygonal shape. Referring also to FIG. 10, the cover 314 has a length L2 longer than a length L1 of the collar 312, e.g., 1.25 to 2 times longer than the length of the collar 312. For example, the length L2 of the cover 314 is between 9.0 cm and 14.0 cm, e.g., between 9.0 cm and 12.0 cm, 10.0 cm and 13.0 cm, or 11.0 cm and 14.0 cm, and the length L1 of the collar 312 is between 6.0 cm and 11.0 cm, e.g., between 6.0 cm and 9.0 cm, 7.0 cm and 10.0 cm, or 8.0 cm and 11.0 cm.

The cover 314 is movable relative to the opening 317 of the filter bag 304 between an open position in which the opening 317 of the filter bag 304 is accessible and a closed position in which the opening 317 of the filter bag 304 is inaccessible. For example, referring to FIG. 8, the cover 314 is a slider that is slidable relative to the collar 312. The collar 312 includes clips 318 (shown in FIG. 10) attaching the cover 314 to the collar 312 while allowing the cover 314 to slide relative to the collar 312.

Referring to FIG. 10, the cover 314 includes an opening 320 and a body 322. The opening 320 can be a substantially circular opening in the body 322 of the cover 314. In some implementations, the opening 320 includes non-circular portions, or is otherwise polygonal. When the cover 314 is in the open position (as shown in FIG. 10), the opening 320 is aligned with and overlaps with the opening 317 of the filter bag 304 and the opening 338 defined by the seal 316. When the cover 314 is in the closed position (not shown), the body 322 overlaps with and covers the opening 317 of the filter bag 304 and the opening 338 defined by the seal 316 such that debris cannot enter or exit from the receptacle 302 (shown in FIGS. 5 and 6).

The cover 314 is manually movable by a human user so that the user can easily close off the receptacle 302 to prevent debris from falling out the filtering device 300 when the user wishes to dispose of the filtering device 300. The collar 312 can further include tabs 313 that enable a human user to more easily grasp the collar 312 while manually moving the cover 314, and the length L2 of the cover 314 can be longer than the length L1 of the collar 312 so that the user can easily grasp the cover 314 and reposition the cover 314 relative to the collar 312.

The conduit 308 is a hollow tube-like structure that provides an airflow pathway for the airflow generated by the air mover 117 of the evacuation station 100 when the filtering device 300 is connected to the evacuation station 100. Referring to FIG. 6, the conduit 308 extends inwardly from the collar 312 into the receptacle 302 of the filtering device 300 and away from the filter bag 304. The conduit 308 and the collar 312 are attached to one another. In some implementations, referring also to FIG. 8, the conduit 308 can include a first portion of a snap fit mechanism 324 attached to a second portion of the snap fit mechanism 324 on the collar 312. For example, the first portion of the snap fit mechanism 324 can include multiple snaps, and the second portion of the snap fit mechanism 324 can include multiple slots with which the multiple snaps are engaged. Alternatively, the first portion of the snap fit mechanism 324 can include multiple slots, and the second portion of the snap fit mechanism 324 can include multiple snaps configured to engage with the multiple slots.

The conduit 308 is formed from a rigid polymer. For example, referring to FIGS. 6-8, the conduit 308 can be formed from polypropylene, polycarbonate, acrylonitrile butadiene styrene, nylon, another appropriate polymer, or a combination of materials including an appropriate polymer. The conduit 308 tapers inward from the opening 317 of the filter bag 304 along at least a portion of the conduit 308. In some implementations, the conduit 308 includes a substantially frustoconical portion 326 that tapers away from the opening 317 of the filter bag 304. The The conduit 308 includes an attached end portion 330 attached to the collar 312, and a free end portion 332. The attached end portion 330 has an opening 331 (not visible) having a width greater than a width W3 of the opening 334 and a width W4 of the opening 338 defined by the seal 316. The opening of the attached end portion 330 is positioned proximate the inlet 306 of the filtering device 300. The free end portion 332 includes an opening 334 within the receptacle 302. Referring to FIG. 7, an angle 335 between an outer surface of the conduit 308 of the filtering device 300 and a longitudinal axis 336 of the conduit 308 of the filtering device 300 is between 10 and 45 degrees, e.g., between 10 and 25 degrees, 20 and 35 degrees, or 30 and 45 degrees. In some implementations, a portion 328 of the conduit 308 proximate the collar 312 is not tapered. For example, the portion 328 can be substantially cylindrical.

Figure 9:
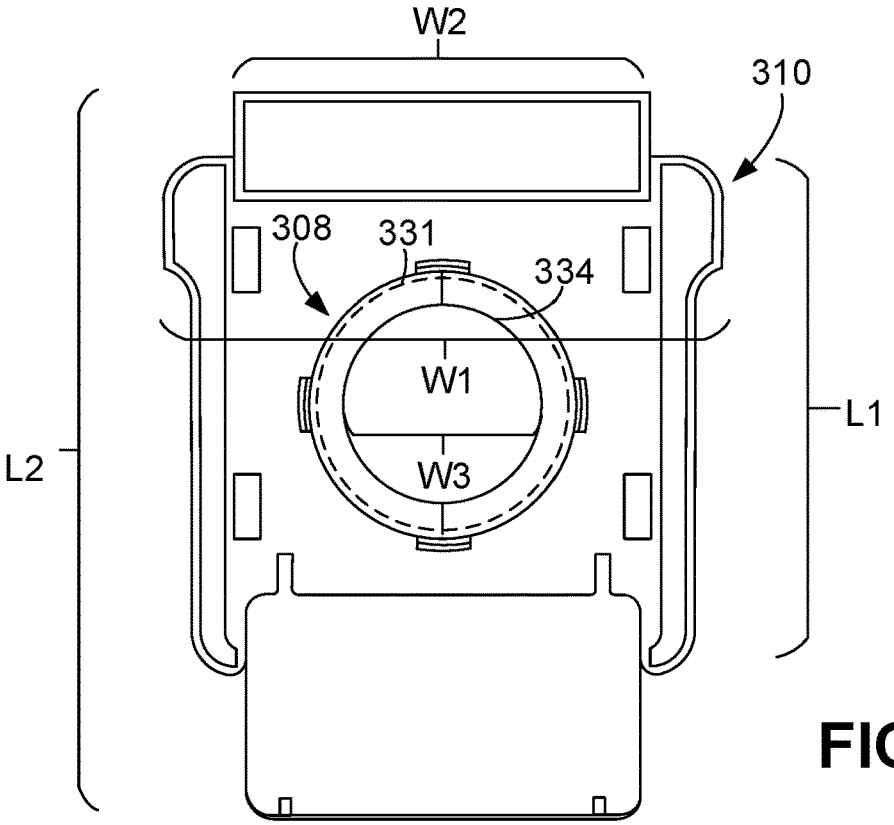
FIG. 9 is a rear view of the interface assembly of FIG. 8.

Referring to FIG. 9, a width W3 of the opening 334 of the conduit 308 is between 2.0 cm and 5.0 cm, e.g., between 2.0 cm and 3.0 cm, 3.0 cm and 4.0 cm, or 4.0 cm and 5.0 cm. Referring also to FIG. 10, the width W3 is substantially equal to a width W4 of the opening 338 defined by the seal 316. For example, the width W4 is between 90% and 110% of the width W3, e.g., between 90% and 100%, between 95% and 105%, or between 100% and 110% of the width W3. In implementations in which the opening 334 and the opening 338 are substantially circular, the widths W3, W4 correspond to diameters of the openings 334, 338. In other implementations, the openings 334, 338 are non-circular, e.g., polygonal. Referring also to FIG. 7, the width W3 is 1 to 2 times larger than a length L3 of the conduit 308, e.g., 1 to 1.5 times, 1.25 times to 1.75 times, or 1.5 times to 2 times larger than the length L3. The length L3 of the conduit 308, for example, corresponds to an overall distance from the opening 317 of the filter bag 304 to the opening 334 of the conduit 308. For example, the length L3 of the conduit 308 can be between 1 and 4 cm, e.g., between 1 and 2 cm, 2 and 3 cm, or 3 and 4 cm.

Figure 11:
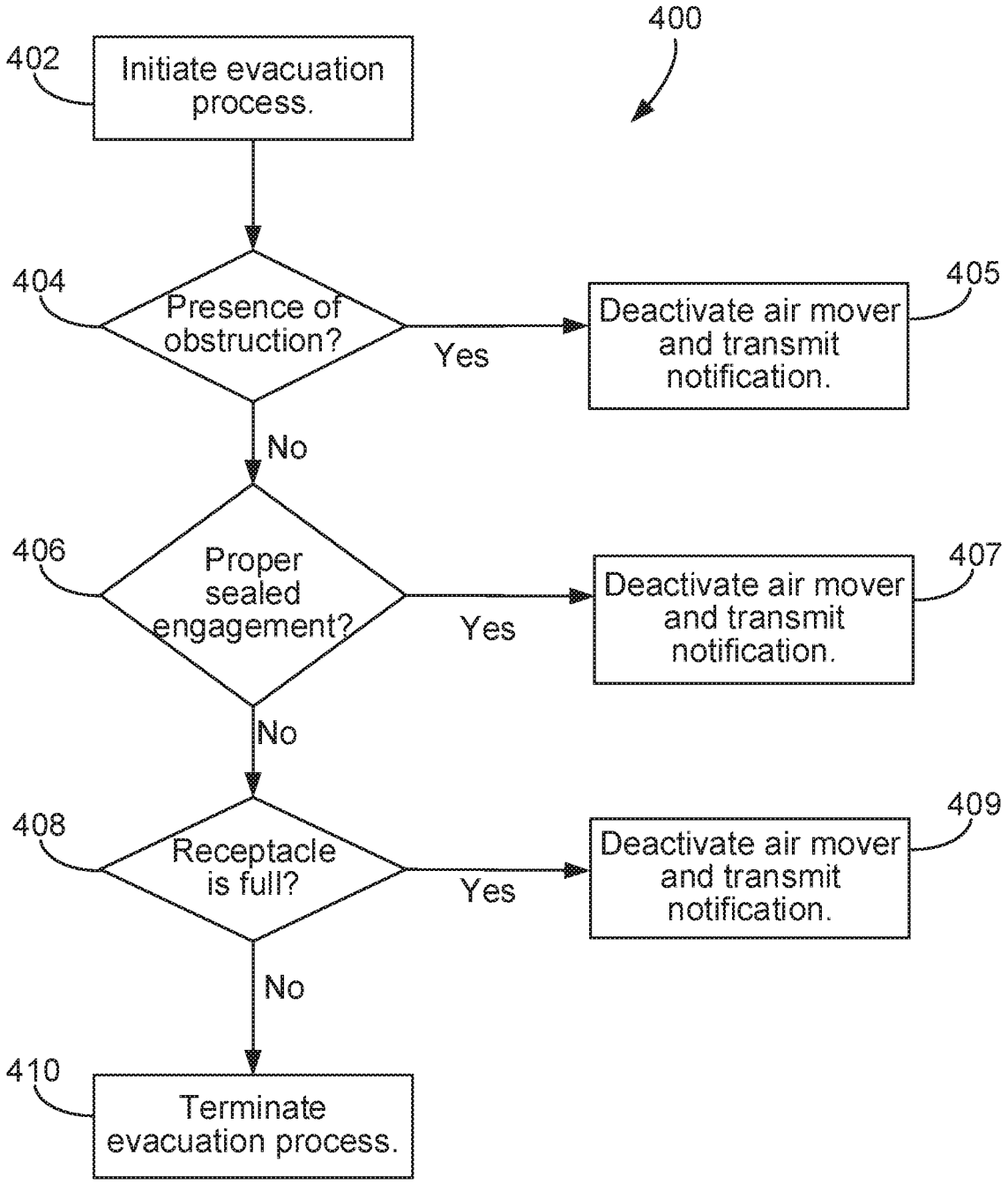
FIG. 11 is a flow chart illustrating a process for detecting an obstruction along an airflow pathway of an evacuation station and performing an evacuation operation.

FIG. 11 illustrates an example process 400 executed by the controller 113 of the evacuation station 100. After the robot 200 has docked at the evacuation station 100, the controller 113 at operation 402 initiates an evacuation process. During the evacuation process, the controller 113 activates the air mover 117, thereby generating the airflow to evacuate debris from the debris bin 204 of the robot 200.

Figure 12A:
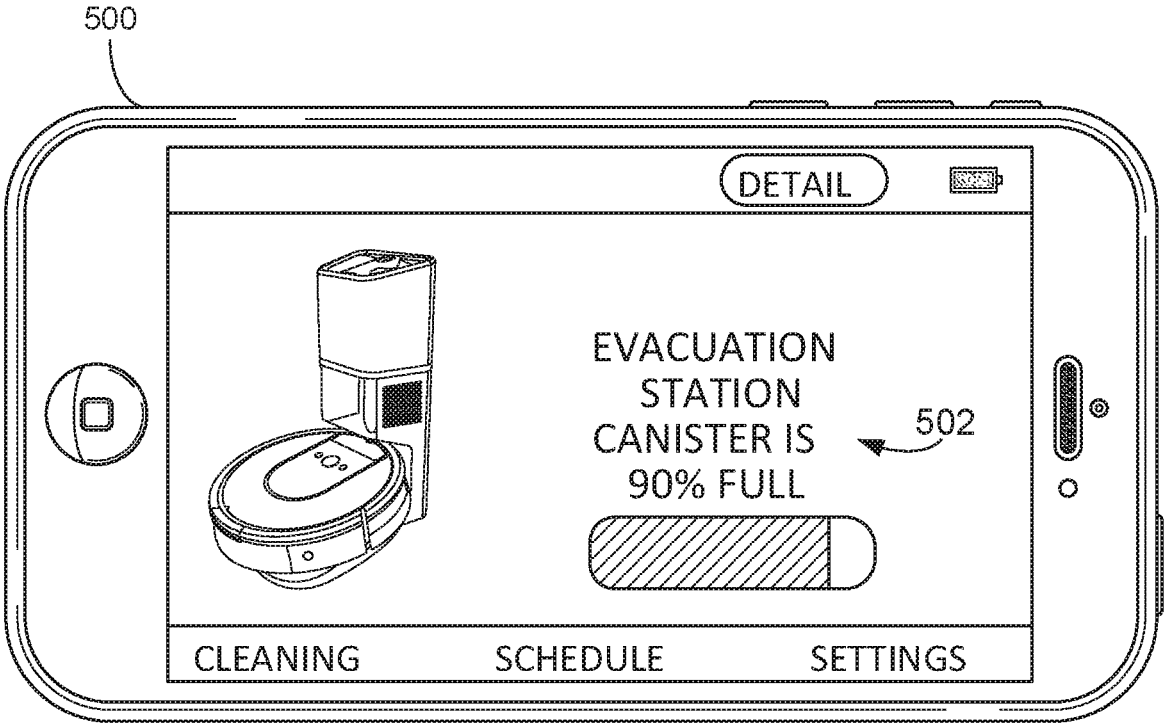
FIGS. 12A-12F are front views of remote computing devices presenting user notifications.

In some implementations, the sensor 126 (shown in FIG. 1) can be a pressure sensor that generates one or more signals indicative of a steady-state pressure within the receptacle 130 of the evacuation station 100. During the evacuation process, referring to FIG. 12A, the controller 113 can transmit data indicative of the steady-state pressure to a remote computing device 500, e.g., a smartphone, a personal computer, a smartwatch, smartglasses, augmented reality device, or other remote computing device. For example, the controller 113 can directly transmit the data to the remote computing device 500, e.g., via a Bluetooth, LAN, or other appropriate wireless communication protocol, or the controller 113 can transmit the data to the remote computing device 500 via a remote server. As shown in FIG. 12A, the steady-state pressure can be indicative of a fullness state of the evacuation station 100. Based on the steady-state pressure, the remote computing device 500 can present a notification 502 indicative of the fullness state of the evacuation station 100. For example, the notification 502 can indicate a percentage of the total debris capacity of the filtering device 300 occupied by accumulated debris.

At operation 404, the controller 113 determines a presence or absence of a clog or other obstruction within flow pathways of the evacuation station 100. If the controller 113 determines the presence of a clog or other obstruction, the controller 113 at operation 405 can deactivate the air mover 117 and transmit a notification to the user to indicate that a clog or other obstruction has been detected.

At operation 406, the controller 113 determines whether a proper sealed engagement between the seal 316 and the conduit 114 has been formed. If the controller 113 determines a proper sealed engagement has not been formed, the controller 113 at operation 407 can deactivate the air mover 117 and transmit a notification to the user to indicate that an improper sealed engagement has been detected.

At operation 408, the controller 113 determines whether the receptacle 302 of the filtering device 300 is full. If the controller 113 determines the receptacle 302 of the filtering device 300 is full, the controller 113 at operation 409 can deactivate the air mover 117 and transmit a notification to the user to indicate that the receptacle 302 of the filtering device 300 is full.

Figure 12B:
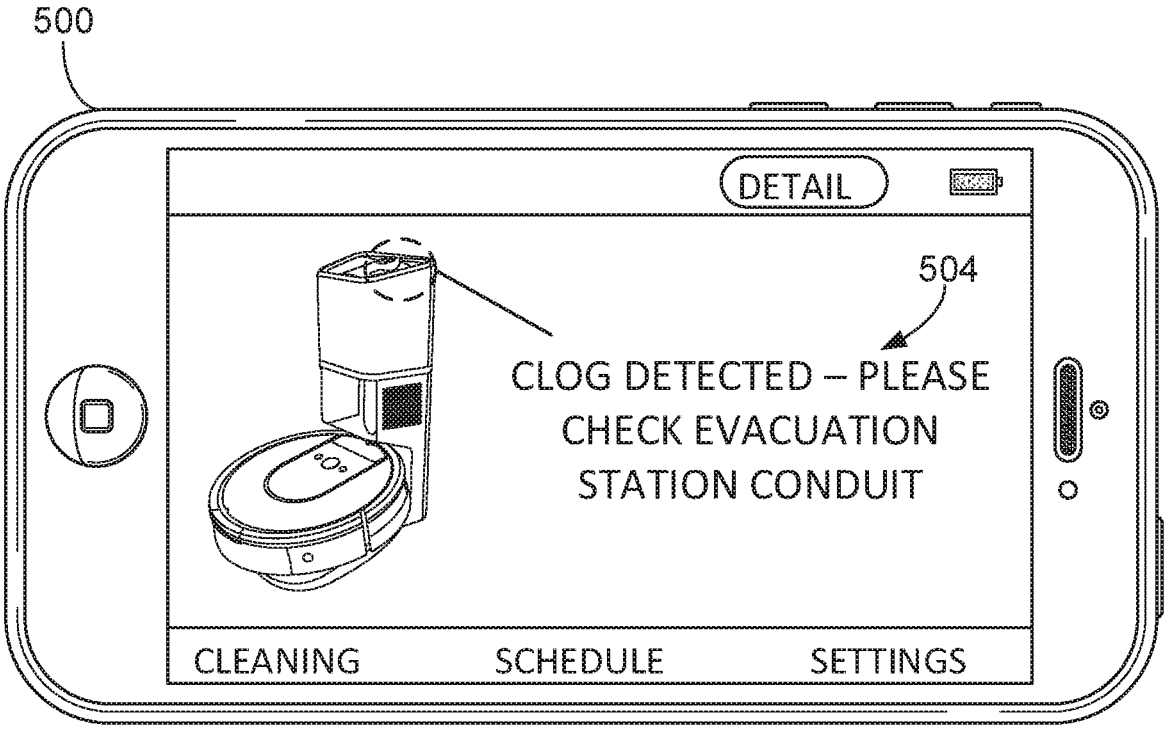

The controller 113 can make the determinations in operations 404, 406, 408 using the one or more signals received from the sensor 126. As described herein, the sensor 126 can be a pressure sensor that generates the one or more signals indicative of a steady-state pressure within the receptacle 130 of the evacuation station 100, and this steady-state pressure can be indicative of a presence or absence of a clog or other obstruction, a proper or improper sealed engagement, or a fullness state of the filtering device 300. For example, if the one or more signals is indicative of a steady-state pressure larger than an expected range for the steady-state pressure, the controller 113 can determine that a clog or other obstruction is present within the airflow pathways of the evacuation station 100. The expected range for the steady-state pressure can be computed based on the range of steady-state pressures detected by the sensor 126 during previous successful evacuation processes performed by the evacuation station 100. Referring to FIG. 12B, if the controller 113 determines that a clog or other obstruction is present, the controller 113 can transmit data indicative of the presence of this clog or other obstruction to the remote computing device 500, and the remote computing device 500 can present a notification 504 indicative of the presence of this clog or other obstruction. The notification 504 can include an instruction for the user to check the one or more conduits of the evacuation station 100 to remove the clog or other obstruction.

Figure 12C:
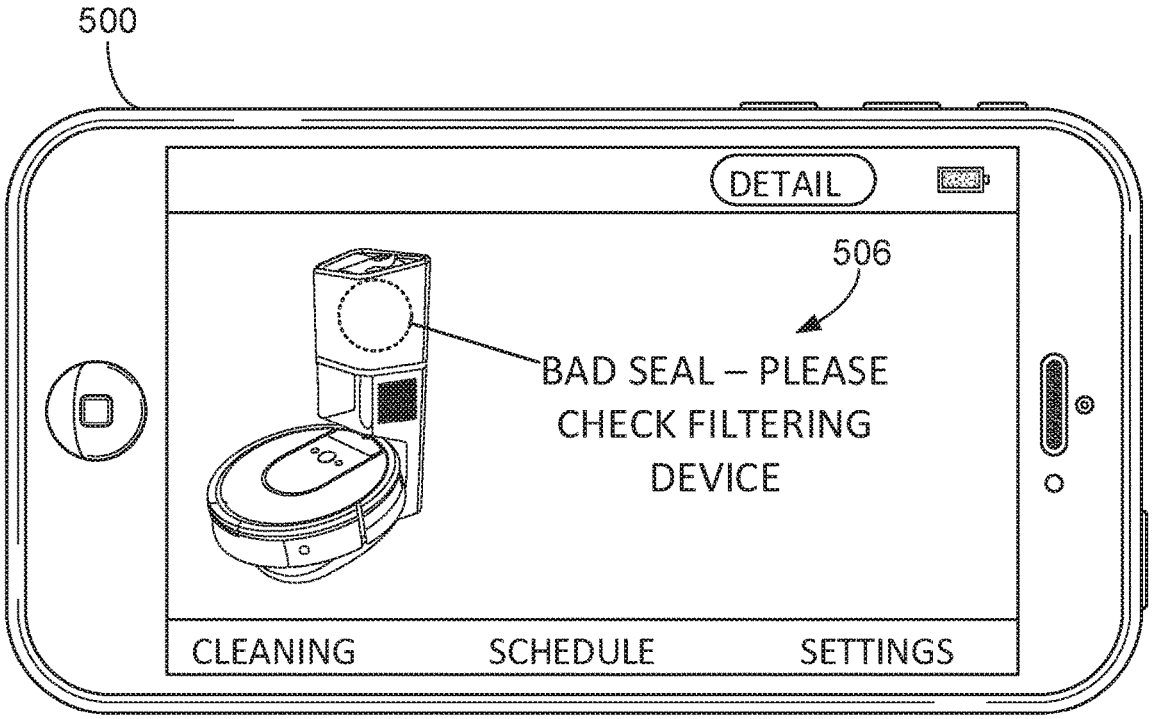

If the one or more signals is indicative of a steady-state pressure less than the expected range for the steady-state pressure, the controller 113 can determine that an improper sealed engagement has been formed between the seal 316 and the conduit 114. Referring to FIG. 12C, if the controller 113 determines that an improper sealed engagement has been formed, the controller 113 can transmit data indicative of the improper sealed engagement to the remote computing device 500, and the remote computing device 500 can present a notification 506 indicative of the improper sealed engagement. The notification 506 can include an instruction to the user to check the filtering device 300 and ensure that the filtering device 300 is properly seated within the receptacle 130 of the evacuation station 100. The notification 506 can alternatively or additionally include an instruction to check the cover 128 of the evacuation station 100 to ensure that the cover 128 is fully closed.

Figure 12D:
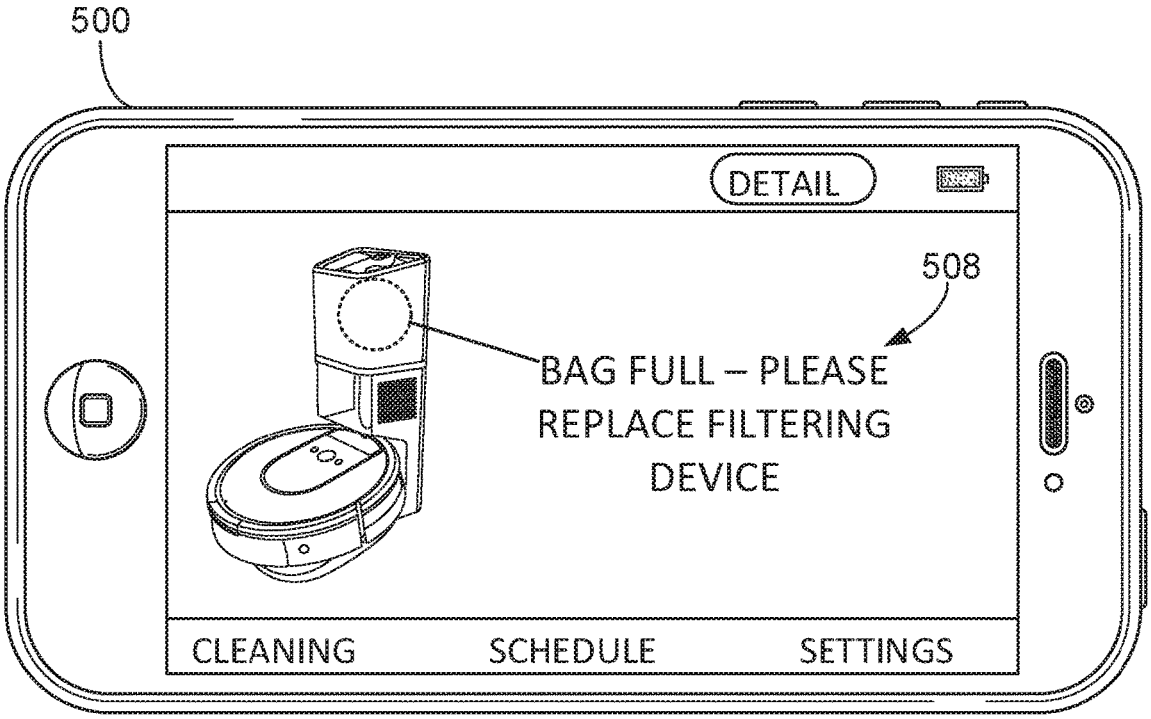
Figure 12E:
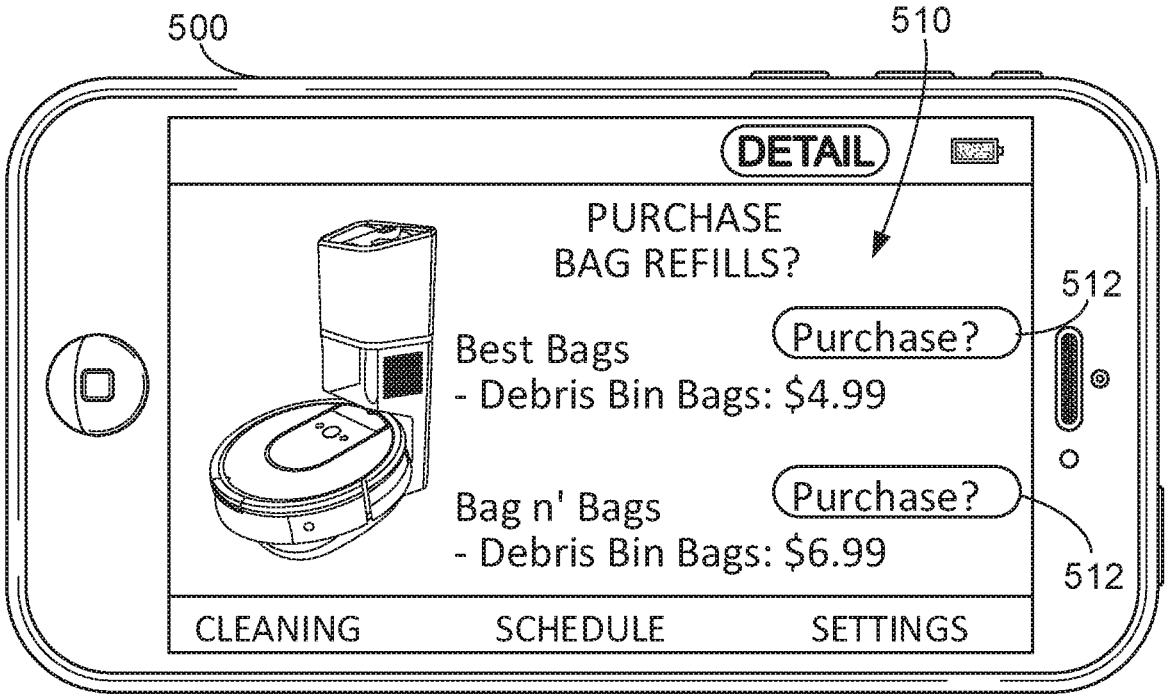

If the one or more signals is indicative of a steady-state pressure larger than a bag-full threshold pressure, the controller 113 can determine that the filtering device 300 is full. In some implementations, the controller 113 can prevent a subsequent evacuation process from being initiated in response to the sensor 126 detecting that the receptacle 302 of the filtering device 300 is in a full state. The controller 113 can provide an alert indicating that the filtering device 300 should be replaced in response to the sensor 126 detecting that the receptacle 302 of the filtering device 300 is nearing or at a full state. For example, referring to FIG. 12D, if the controller 113 determines that the filtering device 300 is full, the controller 113 can transmit data indicative of the fullness state of the filtering device 300 to the remote computing device 500, and the remote computing device 500 can present a notification 508 indicating that the user should check the filtering device 300 and remove the filtering device 300 from the evacuation station 100. In some examples, referring to FIG. 12E, the controller 113 additionally or alternatively can present a notification 510 indicating that the user should order one or more additional filtering devices. The notification 510 can include user interface elements 512 enabling the user to directly order a filtering device to be delivered to the user's home.

Figure 12F:
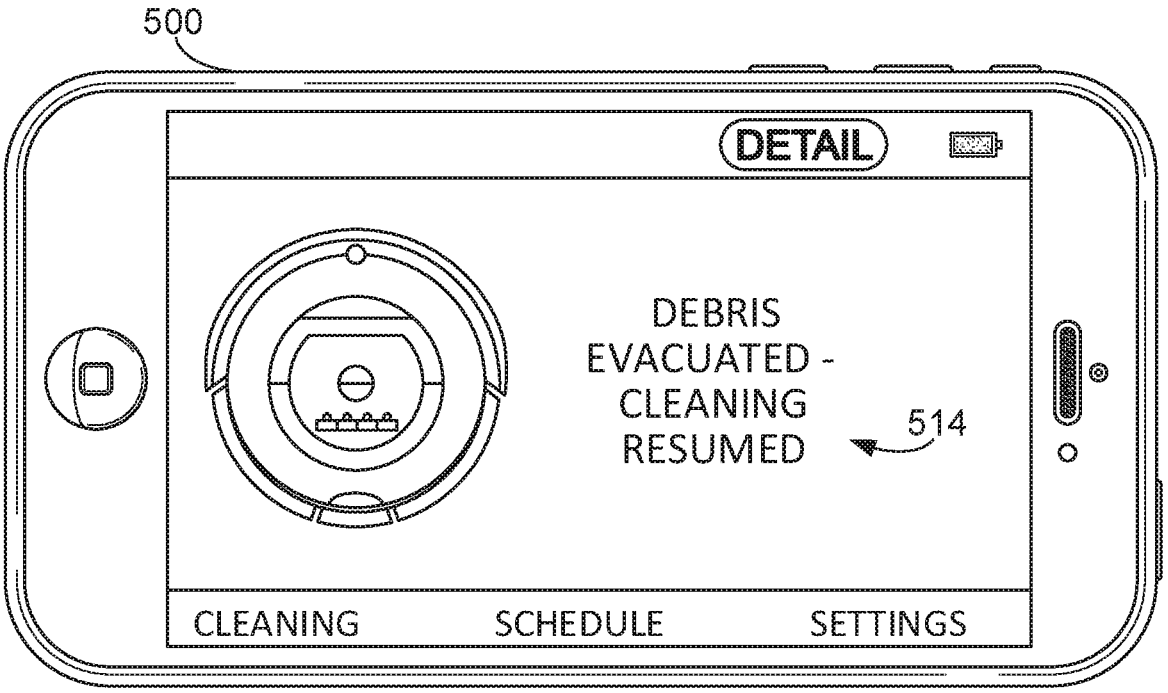

At operation 410, if a predefined duration for the evacuation process has elapsed and the triggering events for operations 404, 406, 408 have not occurred, the controller 113 terminates the evacuation process. The controller 113 can deactivate the air mover 117 and transmit a notification to the user to indicate that the evacuation process has been complete. Referring to FIG. 12F, the controller 113 can transmit data indicative of the termination of the evacuation process to the remote computing device 500, and the remote computing device 500 can present a notification 514 indicating that the evacuation process is complete. In some implementations, if the robot 200 continues to clean the room after the evacuation process is complete, the notification 514 further indicates the robot 100 has resumed cleaning. While FIGS. 12A-12F show examples of a remote computing device 500 presenting a visual notification indicative of status or conditions of the evacuation station 100 or the robot 200, in other implementations, the remote computing device 500 can present audible, tactile, or other types of notifications.

Figure 13:
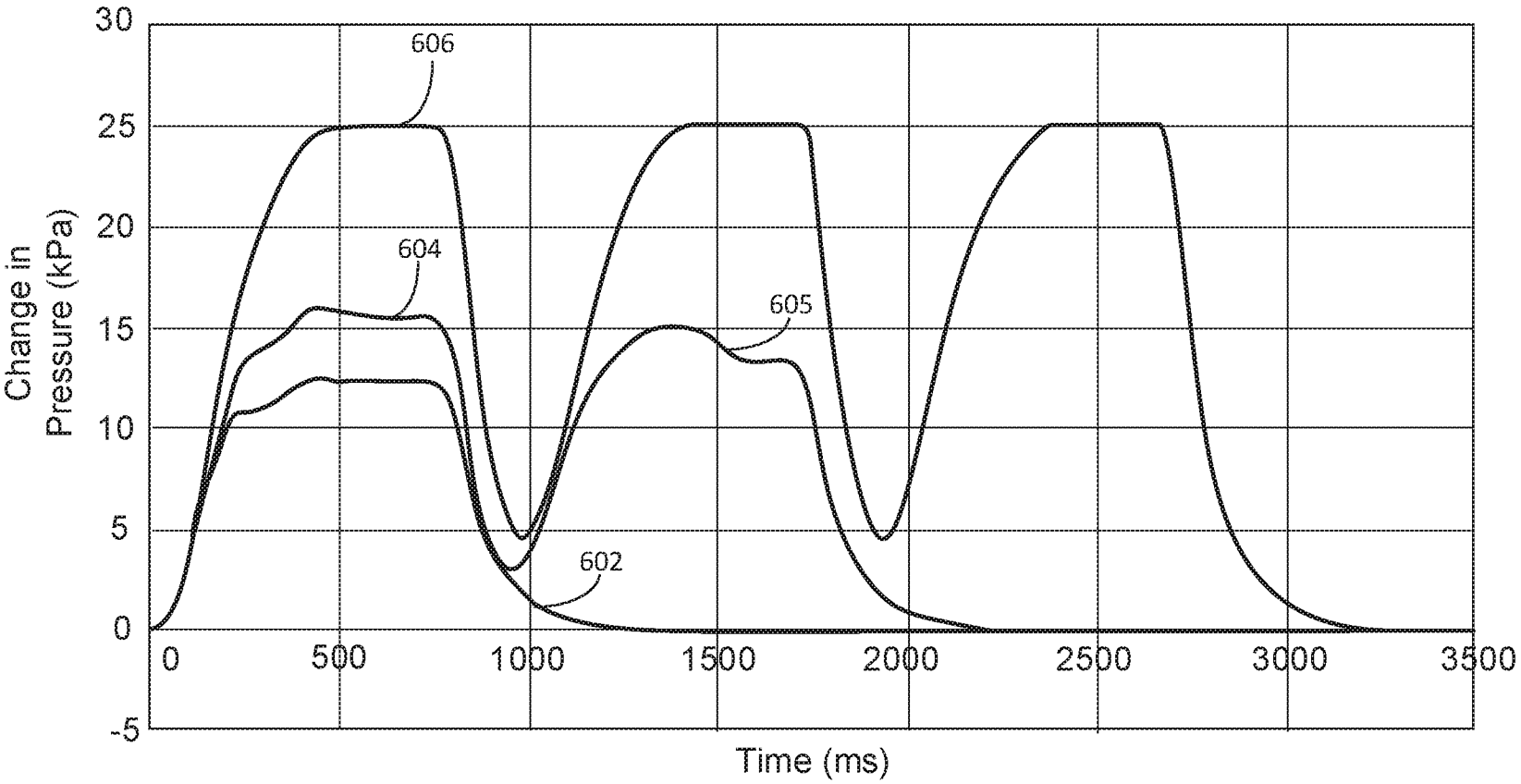
FIG. 13 is a graph illustrating examples of evacuation processes.

FIG. 13 is a graph of steady-state pressure during various types of processes executed by the controller 113 to evacuate debris from the robot 200. During a data trace 602 representing a process, the controller 113 activates the air mover 115 and operates the air mover 115 for a predefined duration of time, e.g., 5 to 15 seconds. The controller 113 then deactivates the air mover 115 after the predefined duration of time. The process represented by the data trace 602 corresponds to an evacuation process in which the controller 113 does not detect the presence of a clog, a poorly formed sealed engagement, or a full state of the filtering device 300. In this regard, the steady-state pressure does not exceed the expected range for steady state pressures. A data trace 604 represents an example of a process executed by the controller 113 to dislodge a detected clog or other obstruction. The controller 113 activates the air mover 115 multiple times to dislodge the clog or other obstruction. During the process represented by the data trace 604, the controller 113 activates the air mover 115 and operates the air mover 115 for the predefined duration of time. The controller 113 determines that a clog or other obstruction is present in the airflow pathways of the evacuation station 100. The controller 113 accordingly briefly deactivates the air mover 115 and then immediately, e.g., within 1 to 2 seconds, activates the air mover 115 again. The controller 113 operates the air mover 115 for the predefined duration of time. The controller 113 then detects a drop off 605 in the steady-state pressure and determines that the clog or other obstruction has been dislodged or has otherwise been neutralized. The controller 113 then deactivates the air mover 115 after the predefined duration of time. In some implementations, three or more activations of the air mover 115 are required to dislodge the clog or other obstruction. Alternatively, in some implementations, the controller 113 does not activate the air mover 115 more than three times. If the clog or other obstruction has not been dislodged after three activations, the controller 113 terminates the evacuation process and transmits a notification to the user to indicate that a clog or other obstruction has been detected and instruct the user to address the issue.

A data trace 606 represents an example process executed by the controller 113 when the filtering device 300 is full. The controller 113 activates the air mover 115 multiple times to ensure that the debris in the filtering device 300 has properly settled and that the debris capacity of the filtering device 300 has been reached. During the process represented by the data trace 606, the controller 113 activates the air mover 115 and operates the air mover 115 for the predefined duration of time. The controller 113 determines that the filtering device 300 is full. The controller 113 accordingly briefly deactivates the air mover 115 and then immediately, e.g., within 1 to 2 seconds, activates the air mover 115 again. The controller 113 operates the air mover 115 for the predefined duration of time. The controller 113 again determines that the filtering device 300 is full. The controller 113 then briefly deactivates the air mover 115 and then immediately, e.g., within 1 to 2 seconds, activates the air mover 115 again. The controller 113 operates the air mover 115 for the predefined duration of time. The controller 113 again determines that the filtering device 300 is full. After three activations, the controller 113 deactivates the air mover 115 and transmits a notification to the user that the filtering device is full. While the process represented by the data trace 606 is described as including three activations of the air mover 115, in other implementations, two, four, or more activations of the air mover 115 can occur in response to determination that the filtering device 300 is full.

A number of implementations have been described. Nevertheless, it will be understood that various modifications may be made.

The robots and evacuation stations described herein can be controlled, at least in part, using one or more computer program products, e.g., one or more computer programs tangibly embodied in one or more information carriers, such as one or more non-transitory machine-readable media, for execution by, or to control the operation of, one or more data processing apparatus, e.g., a programmable processor, a computer, multiple computers, and/or programmable logic components.

Operations and processes associated with controlling the robots and evacuation stations described herein can be performed by one or more programmable processors executing one or more computer programs to perform the functions described herein. A computer program can be written in any form of programming language, including compiled or interpreted languages, and it can be deployed in any form, including as a stand-alone program or as a module, component, subroutine, or other unit suitable for use in a computing environment. Control over all or part of the robots and the evacuation stations described herein can be implemented using special purpose logic circuitry, e.g., an FPGA (field programmable gate array) and/or an ASIC (application-specific integrated circuit).

The controllers (e.g., the controller 113, the controller 206) described herein can include one or more processors. Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass PCBs for storing data, e.g., magnetic, magneto-optical disks, or optical disks. Machine-readable storage media suitable for embodying computer program instructions and data include all forms of non-volatile storage area, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks. While the controller 113 of the evacuation station 100 is described as controlling the air mover 115 and performing other operations as described herein, in other implementations, the controller 206 of the robot 200, a remote server, or a combination of various controllers described herein can be used to control the operations of the evacuation station 100.

While the conduit 308 is described as being formed from a rigid polymer, in some implementations, the conduit 308 is formed from a flexible material. The conduit 308 can be a thin piece of polymeric material. The conduit 308 can formed from, for example, polyurethane, latex, rubber, an elastomer, another appropriate flexible material, or a combination of multiple appropriate materials that provide flexibility. The conduit 308 can be sufficiently flexible such that the conduit 308 droops when the air mover 115 of the evacuation station 100 is not operated. During operation of the air mover 115, the conduit 308 can expand to allow the airflow generated by the air mover 115 to pass through the conduit 308.

While the sensor 126 is described, in some implementations, the evacuation station 100 includes multiple sensors positioned along or proximate the airflow pathways of the evacuation station 100. For example, the evacuation station 100 can include two pressure sensors, with one pressure sensor located on opposing sides of an airflow pathway. In some implementations, a first pressure sensor can be located within the canister, such as near the filtering device 300, and a second pressure sensor can be located near the intake 118 of the evacuation station 100. Based on signals from the multiple sensors, the controller 113 can determine a particular location along the airflow pathways of a clog or other obstruction or an air leak.

While the filtering device 300 is described as a bag-based filtering device including the filter bag 304, in other implementations, the filtering device 300 includes a rigid container to which the collar 312 is attached. In some implementations, the filtering device 300 is a reusable container that can be emptied by a user and, in some cases, be cleaned for subsequent reuse with an evacuation station.

The cover 314 is described in some implementations as being slidable relative to the collar 312. In some cases, as described herein, the cover 314 is translatable relative to the cover 312. Additionally or alternatively, the cover 314 is rotatable relative to the cover 314 between the open and closed positions. In some implementations, the seal 316 serves as a cover for the opening 317 of the filter bag 304. For example, the seal 316 can cover substantially an entirety of the opening 317 of the filter bag 304, e.g., 75% to 95%. The conduit 114 in the protruded position can be penetrate the seal 316 and thereby enlarge the opening 338 defined by the seal 316. The seal 316 can include several slits that impart the flexibility for allowing the conduit 114 to penetrate the seal 316.

While the snap fit mechanism 324 is described as attaching the conduit 308 to the collar 312, in other implementations, a mechanism for attaching the conduit 308 to the collar 312 includes adhesive attachment, welding, an interference fit mechanism, or other appropriate attachment mechanism.

Accordingly, other implementations are within the scope of the claims.

What is claimed is:

1. A bag-based filtering device for collecting debris from a cleaning robot via a debris evacuation station, the filtering device comprising:

a filter bag at least partially forming a receptacle therein for receiving at least a portion of the debris, the filter bag configured to separate at least the portion of the debris from a flow of air generated by the evacuation station;

an inlet comprising a seal, the inlet configured to interface with an outlet of the evacuation station, and the seal defining an opening of the inlet; and a conduit extending inward from an opening of the filter bag into the receptacle, the conduit having a substantially cylindrical portion extending inward from the opening of the filter bag, and a substantially frustoconical portion extending inward from the substantially cylindrical portion, the conduit comprising an opening proximate the inlet, the opening of the conduit having a width greater than a width of the opening of the inlet, wherein the conduit is configured to pneumatically connect the receptacle with the inlet of the filtering device to direct the flow of air generated by the evacuation station through the filter bag to separate at least the portion of the debris from the flow of air.

2. The filtering device of claim 1, wherein:

the opening of the conduit is a first opening of the conduit, the conduit of the filtering device tapers inward from the opening of the filter bag along at least a portion of the conduit of the filtering device, and a free end portion of the conduit of the filtering device comprises a second opening having a width 1 to 2 times larger than an overall distance from the opening of the filter bag to the second opening of the conduit.

3. The filtering device of claim 2, further comprising:

a cover slidable relative to the opening of the filter bag between an open position in which the opening of the filter bag is accessible and a closed position in which the opening of the filter bag is inaccessible, and a collar attached to the filter bag, wherein the cover is slidable relative to the collar between the open position and the closed position.

4. The filtering device of claim 3, wherein the cover comprises a body and an opening, the body configured to cover the opening of the filter bag when the cover is in the closed position, and the opening of the cover configured to align with the opening of the filter bag when the cover is in the open position.

5. The filtering device of claim 2, wherein the seal is an outward facing seal configured to interface with the outlet of the evacuation station.

6. The filtering device of claim 5, wherein a width of the second opening of the conduit of the filtering device is substantially equal to a width of the opening of the inlet.

7. The filtering device of claim 1, further comprising a collar positioned along the opening of the filter bag, the collar attached to the filter bag and attached to the conduit of the filtering device.

8. The filtering device of claim 7, wherein the conduit of the filtering device comprises a first portion of a snap fit mechanism attached to a second portion of the snap fit mechanism on the collar.

9. The filtering device of claim 1, wherein the conduit of the filtering device is formed of a rigid polymer.

10. The filtering device of claim 1, wherein a length of the conduit of the filtering device is between 1 and 4 cm.

11. The filtering device of claim 1, wherein an angle between an outer surface of the conduit of the filtering device and a longitudinal axis of the conduit of the filtering device is between 10 and 45 degrees.

12. The filtering device of claim 1, wherein:

the opening of the conduit is a first opening of the conduit, and a width of a second opening of the conduit of the filtering device at a free end portion of the conduit of the filtering device is between 2 cm and 5 cm.

13. The filtering device of claim 1, wherein the conduit is configured to inhibit accumulation of debris within the conduit.

14. An evacuation station comprising:

one or more conduits comprising an intake configured to interface with a cleaning robot;

a filtering device comprising a filter bag at least partially forming a receptacle therein for receiving at least a portion of debris evacuated from the cleaning robot, the filter bag configured to separate at least the portion of the debris from a flow of air generated by the evacuation station, an inlet comprising a seal, the inlet configured to interface with an outlet of the one or more conduits, and the seal defining an opening of the inlet, and a conduit configured to pneumatically connect the inlet to the receptacle to direct the flow of air generated by the evacuation station through the filter bag to separate at least the portion of the debris from the flow of air, the conduit extending inward from an opening of the filter bag into the receptacle, the conduit having a substantially cylindrical portion extending inward from the opening of the filter bag, and a substantially frustoconical portion extending inward from the substantially cylindrical portion, the conduit comprising an opening proximate the inlet, the opening of the conduit having a width greater than a width of the opening of the inlet; and an air mover configured to produce the flow of air containing debris from a debris bin of the cleaning robot, the flow of air travelling through the one or more conduits, through the conduit of the filtering device, and through the filter bag such that at least a portion of the debris is separated from the flow of air and received by the receptacle.

15. The evacuation station of claim 14, wherein:

the conduit of the filtering device tapers inward from the opening of the filter bag along at least a portion of the conduit of the filtering device, and a free end portion of the conduit of the filtering device comprises an opening having a width 1 to 2 times larger than an overall distance from the opening of the filter bag to the opening of the conduit.

16. The evacuation station of claim 15, wherein the filtering device further comprises:

a cover slidable relative to the opening of the filter bag between an open position in which the opening of the filter bag is accessible and a closed position in which the opening of the filter bag is inaccessible, and a collar attached to the filter bag, wherein the cover is slidable relative to the collar between the open position and the closed position.

17. The evacuation station of claim 16, wherein the cover comprises a body and an opening, the body configured to cover the opening of the filter bag when the cover is in the closed position, and the opening of the cover configured to align with the opening of the filter bag when the cover is in the open position.

18. The evacuation station of claim 15, wherein the inlet comprises an outward facing seal configured to interface with the outlet of the one or more conduits.

19. The evacuation station of claim 18, wherein a width of an opening of the conduit of the filtering device is substantially equal to a width of an opening of the outward facing seal.

20. The evacuation station of claim 14, wherein the filtering device comprises a collar positioned along the opening of the filter bag, the collar attached to the filter bag and attached to the conduit of the filtering device.

21. The evacuation station of claim 20, wherein the conduit of the filtering device comprises a first portion of a snap fit mechanism attached to a second portion of the snap fit mechanism on the collar.

22. The evacuation station of claim 14, wherein the conduit of the filtering device is formed of a rigid polymer.

23. The evacuation station of claim 14, wherein a length of the conduit of the filtering device is between 1 and 4 cm.

24. The evacuation station of claim 14, wherein an angle between an outer surface of the conduit of the filtering device and a longitudinal axis of the conduit of the filtering device is between 10 and 45 degrees.

25. The evacuation station of claim 14, wherein a width of an opening of the conduit of the filtering device at a free end portion of the conduit of the filtering device is between 2 cm and 5 cm.

26. The evacuation station of claim 14, wherein the conduit is configured to inhibit accumulation of debris within the conduit.

27. The evacuation station of claim 14, further comprising:

a sensor positioned proximate a flow path for the flow of air, and a controller configured to prevent an evacuation process from being initiated in response to the sensor detecting that the receptacle of the filtering device is in a full state.

28. The evacuation station of claim 14, further comprising:

a sensor positioned proximate a flow path for the flow of air, and a controller configured to provide an alert indicating that the filtering device should be replaced in response to the sensor detecting that the receptacle of the filtering device is nearing or at a full state.

29. The evacuation station of claim 14, further comprising:

a pressure sensor positioned proximate a flow path for the flow of air, and a controller configured to initiate a first evacuation process in which the air mover is activated for a predefined duration of time, determine that the receptacle of the filtering device is nearing a full state based on a pressure detected by the pressure sensor, and in response to determining that the receptacle of the filtering device is nearing the full state, initiate a second evacuation process in which the air mover is activated for the predefined duration of time.

* * * * *